US011485154B2

(12) United States Patent
Golob et al.

(10) Patent No.: US 11,485,154 B2
(45) Date of Patent: Nov. 1, 2022

(54) MEDIA STACKING MECHANISMS

(71) Applicant: HEWLETT-PACKARD DEVELOPMENT COMPANY, L.P., Spring, TX (US)

(72) Inventors: Lorraine T. Golob, Vancouver, WA (US); Kevin Lo, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 115 days.

(21) Appl. No.: 16/609,458

(22) PCT Filed: May 15, 2018

(86) PCT No.: PCT/US2018/032825
§ 371 (c)(1),
(2) Date: Oct. 30, 2019

(87) PCT Pub. No.: WO2019/221719
PCT Pub. Date: Nov. 21, 2019

(65) Prior Publication Data

US 2021/0394536 A1 Dec. 23, 2021

(51) Int. Cl.
*B41J 13/00* (2006.01)
*B65H 31/26* (2006.01)
(Continued)

(52) U.S. Cl.
CPC ..... *B41J 13/0045* (2013.01); *B65H 31/26* (2013.01); *B65H 31/34* (2013.01);
(Continued)

(58) Field of Classification Search
CPC ..... B41J 13/0045; B65H 31/26; B65H 31/34; B65H 2301/141; B65H 43/00;
(Continued)

(56) References Cited

U.S. PATENT DOCUMENTS 4,147,342 A 4/1979 Naramore
4,988,029 A 1/1991 Fiske
(Continued)

FOREIGN PATENT DOCUMENTS

WO WO2018048425 A1 3/2018

*Primary Examiner* — Henok D Legesse
(74) *Attorney, Agent, or Firm* — Brooks Cameron & Huebsch PLLC

(57) ABSTRACT

Example implementations relate to media stacking mechanisms. In some examples, a printing device can include a stacking mechanism that includes a tamper to tamp print media positioned within the stacking mechanism, and a controller comprising instructions to: tamp a first sheet of print media received at the stacking mechanism a first distance based on a first size of the first sheet of print media, tamp a second sheet of print media received at the stacking mechanism a second distance based on the second size of the second sheet of print media, wherein the second sheet of print media is positioned over the first sheet of print media, and tamp a third sheet of print media received at the stacking mechanism the second distance when the third sheet of print media is the first size, wherein the third sheet of print media is positioned over the second sheet of print media.

14 Claims, 4 Drawing Sheets

(51) Int. Cl.
*B65H 31/34* (2006.01)
*B65H 31/36* (2006.01)
*B65H 43/00* (2006.01)

(52) U.S. Cl.
CPC ..... *B65H 31/36* (2013.01); *B65H 43/00* (2013.01); *B65H 2301/141* (2013.01); *B65H 2301/4212* (2013.01); *B65H 2511/12* (2013.01); *B65H 2511/222* (2013.01); *B65H 2701/18264* (2013.01); *B65H 2801/06* (2013.01)

(58) Field of Classification Search
CPC ..... B65H 2301/4212; B65H 2511/12; B65H 2511/222; B65H 2701/18264; B65H 2801/06; B65H 31/36
See application file for complete search history.

(56) References Cited

U.S. PATENT DOCUMENTS

| | | | | |
|---|---|---|---|---|
| 5,501,442 | A | 3/1996 | Mandel | |
| 6,379,063 | B1 | 4/2002 | Gutierrez et al. | |
| 6,719,522 | B1 | 4/2004 | Gunther | |
| 7,537,209 | B2 | 5/2009 | Kato et al. | |
| RE43,687 | E | 9/2012 | Ohtani | |
| 8,517,368 | B1 | 8/2013 | Brundige et al. | |
| 9,527,693 | B2 | 12/2016 | Herrmann | |
| 9,545,807 | B2 | 1/2017 | Kokura | |
| 9,751,713 | B2 | 9/2017 | Balili et al. | |
| 2003/0020230 | A1 | 1/2003 | Williams et al. | |
| 2008/0067735 | A1* | 3/2008 | Mao | B42C 1/12 271/171 |
| 2009/0087240 | A1* | 4/2009 | Tamura | B65H 33/08 399/405 |
| 2009/0110458 | A1* | 4/2009 | Sato | B65H 31/38 399/405 |
| 2021/0094784 | A1* | 4/2021 | Eden | B65H 31/10 |

* cited by examiner

MEDIA STACKING MECHANISMS

BACKGROUND

Imaging systems, such as printing devices, copiers, etc., may be used to form markings, such as text and images on a physical medium. Imaging systems may form markings on the physical medium by transferring a print substance (e.g., ink, toner, etc.) to the physical medium.

DETAILED DESCRIPTION

Figure 1:
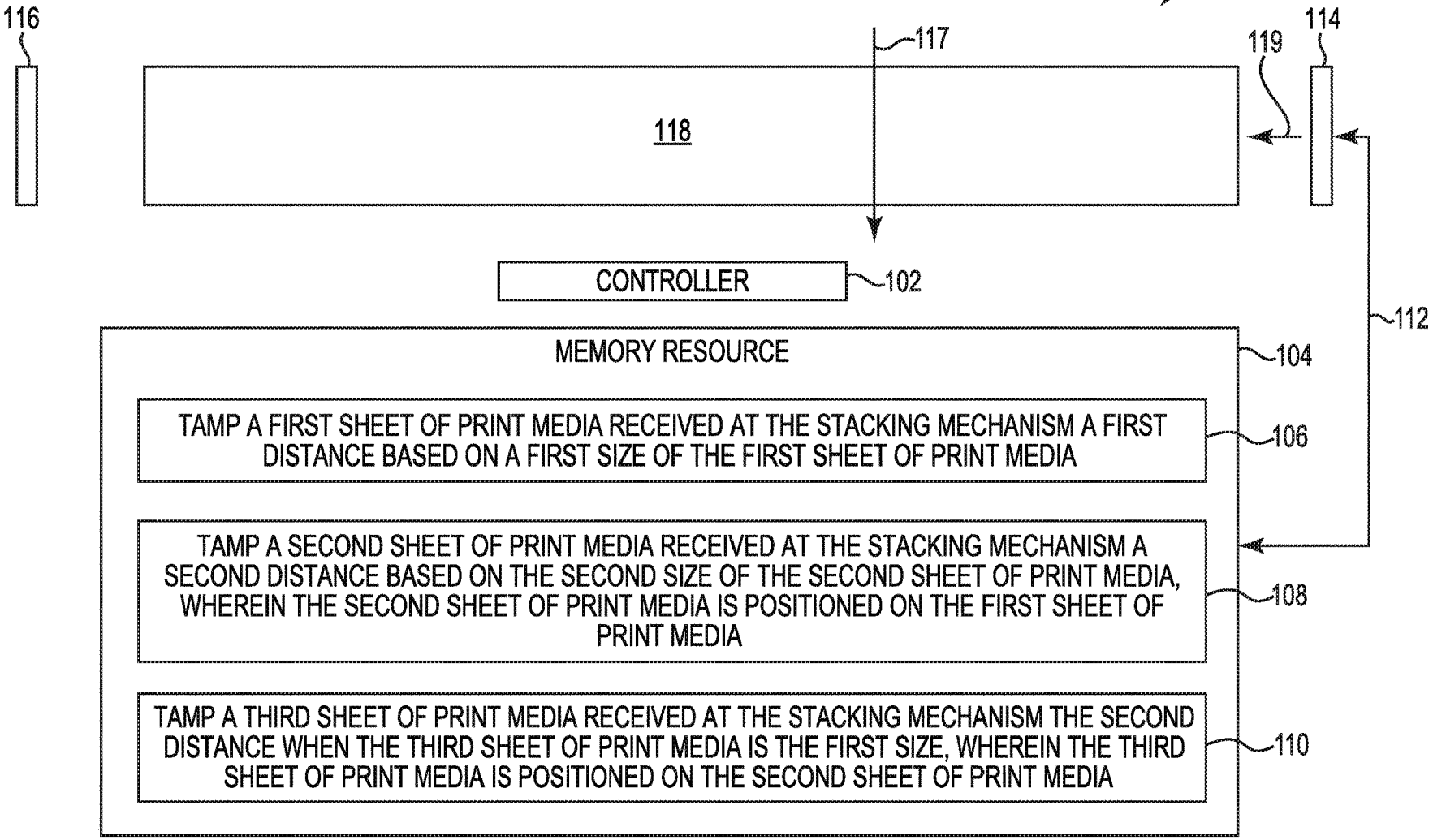
FIG. 1 illustrates an example media stacking device consistent with the present disclosure.

Printing devices can be utilized to form markings on a print media. As used herein, a printing device includes a hardware device that transfers a print substance on to a print media such as paper. For example, a printing device can include an inkjet printer that can deposit liquid or ink on to the print media to form a marking. As used herein, a print substance can include a substance such as liquid or powder that can be deposited on to a print medium to form a marking on the print medium. As used herein, print media can include a physical sheet or stack of physical sheets that can receive or absorb the print substance and display a marking. For example, print media can include a sheet of paper, plastic, vellum, or other type of material that can receive a print substance.

Printing devices can be utilized to generate marking on print media. In some examples, different print media can have different sizes and/or shapes. For example, print media can have a shape of rectangle with a length of 11 inches and a width of 8.5 inches (e.g., 279 mm×216 mm). In another example, print media have a shape of a rectangle with a length of 8 inches (20.32 cm) and a width of 5 inches (12.7 cm). In some examples, the same printing device can be capable of printing markings on a plurality of differently sized print media. For example, a printing device can generate a first print job that utilizes print media that is a first size and the same printing device can generate a second print job that utilizes print media that is a second size. In this example, the first size can be different than the second size. As used herein, a print job can include a completed transfer of a digital image on to a print medium or print media.

In some examples, a print job can include a digital transmission to the printing device that includes instructions about how the print job is to be performed by the printing device. As used herein, a digital transmission can include a digital image to be printed by the printing device and/or instructions for generating the digital image on the print media. For example, the digital transmission can include the image or images to be printed, as well as instructions for color, collating, stacking, stapling, hole punching, etc. In this way, a print job can be a completed digital transmission provided by a computing device.

In some examples, the printing device can receive a digital transmission that includes instructions for generating markings on differently sized print media within the same print job. That is, the printing device can receive a digital transmission where a first sheet of print media is a first size, a second sheet of print media is a second size, and a third sheet of print media is a third size. In some examples, it can be difficult to perform finishing processes for print jobs or digital transmissions that include differently sized print media. For example, a finishing process such as a stacking process can be difficult when all four edges of the print media are not able to be aligned since a first sheet of print media may be larger or smaller than a second sheet of print media. As used herein, a finishing process can include activities performed on printed media or media that has been deposited with a print substance. For example, the print media can be deposited with a print substance and the print media can have a stacking process, hole punching process, and/or stapling process performed on the print media. In this example, the stacking process, hole punching process, and stapling process can be considered finishing processes.

The systems and methods described herein can be utilized to perform a number of finishing processes on print jobs that include differently sized print media. For example, a stacking process can be performed on the differently sized print media to align the differently sized print media along an edge of the differently sized print media. In some examples, the stacking process that is performed on the differently sized print media can enable a stapling process to be performed on the edge that is aligned along the differently sized print media. In this way, the systems and methods described herein can enable finishing processes for print jobs that include differently sized print media.

FIG. 1 illustrates an example media stacking device 100 consistent with the present disclosure. In some examples, the media stacking device 100 can be utilized to stack print media for a print job that includes differently sized print media. In some examples, the media stacking device 100 can include a print media pathway 118 positioned between a first tamper 114 and a second tamper 116.

As used herein, a print media pathway 118 can be physical pathway for transporting print media from a first location to a second location. As used herein, a tamper can include a physical device for applying pressure to an edge of print media, such as to cause the print media to move (e.g., towards and/or against a registration wall or another tamper). In some examples, the print media pathway 118 can receive print media from a print zone of a printing device and allow the print media to be moved in the direction of arrow 117. As used herein, a print zone can include an area of the printing device where a printing substance is deposited on the print media. In some examples, the first tamper 114 can move in the direction of arrow 119 to move the print media from a first side of the print media pathway 118 (e.g., right side of print media pathway 118 as illustrated in FIG. 1) to a second side of the print media pathway 118 (e.g., left side of print media pathway 118 as illustrated in FIG. 1).

In some examples, the second tamper 116 can be utilized as a registration surface to align the print media along an edge of the print media. As used herein, a registration surface can include a physical surface to constrain movement of the print media, such as in a direction of movement induced by a tamper. For example, the first tamper 116 can move in the direction of arrow 119 to push the print media into the second tamper 116 to align an edge of the print media with the surface of the second tamper 116. In some examples, the first tamper 116 can tamp a first sheet of print media a first distance to interact with the second tamper 116 and tamp a second sheet of print media a second distance to interact with the second tamper 116 when the first sheet of print media is a different size than the second sheet of print media. In some examples, the second tamper 116 can be a fixed tamper positioned opposite to the first tamper 114 to guide and register the print media when the first tamper 114 alters a position of the print media.

In some examples, the first tamper 114 can be controlled or operated by a controller 102 in communication with the first tamper 114 via a communication line 112. As used herein, a communication line 112 can include a wired or wireless connection for transmitting or receiving communication. In some examples, the controller 102 may be a processing resource that is coupled to a memory resource 104. As used herein, the controller 102 or processing resource may be a central processing unit (CPU), a semiconductor-based microprocessor, and/or other hardware devices suitable for retrieval and execution of instructions stored in non-transitory computer readable medium (e.g., the memory resource 104). The controller 102 may fetch, decode, and execute instructions 106, 108, 110. As an alternative or in addition to retrieving and executing instructions, the controller 102 may include an electronic circuit that includes electronic components for performing the functionality of instructions 106, 108, 110. As used herein, the memory resource 104 may also be referred to as a non-transitory computer readable medium, and may be a volatile memory (e.g., RAM, DRAM, SRAM, EPROM, EEPROM, etc.) and/or non-volatile memory (e.g., a HDD, a storage volume, data storage, etc.) Although the following descriptions refer to an individual processor or controller 102 and an individual memory, the descriptions may also apply to a system with multiple processors and multiple memories. In such examples, the instructions may be distributed (e.g., stored) across multiple memories and the instructions may be executed by multiple processors.

For instance, the controller 102 may include instructions 106 stored in the memory resource 104 and executable by the controller 102 to cause a tamper to tamp a first sheet of print media received at the stacking mechanism a first distance based on a first size of the first sheet of print media. In some examples, the stacking mechanism can include the first tamper 114, the second tamper 116, and/or the media pathway 118. As used herein, received at the stacking mechanism can include receiving print media from a print zone of a printing device within the media pathway 118. As used herein, to tamp a sheet of print media includes the first tamper 114 moving in the direction of arrow 119 to move the print media within the media pathway 118 toward the second tamper 116.

As used herein, to tamp the sheet of print media a first distance includes the first tamper 114 moving a first distance from a resting state to move the print media the first distance. As described herein, moving the sheet of print media a particular distance can be based on the size of the sheet of print media. For example, a particular sheet of print media can include a particular width or length that can stretch across the first end and the second end of the media pathway 118. In this example, the first tamper 114 may have to move a particular distance in the direction of arrow 119 to move an edge of the particular sheet of print media to the second tamper 116.

In some examples, controller 102 can determine a size of a sheet of print media to be received by the stacking mechanism. For example, the controller 102 can receive the digital transmission that includes the size of each sheet of print media for a particular print job. In this example, the controller 102 can utilize the digital transmission to determine a size of each sheet of print media to be received at the media pathway 118. In some examples, the determined size of the sheet of print media can be utilized to instruct the first tamper 114 to move in the direction of arrow 119 a corresponding distance to move an edge of the sheet of print media to the second tamper 116.

In some examples, the controller 102 may include instructions 108 stored in the memory resource 104 and executable by the controller 102 to cause a tamper to tamp a second sheet of print media received at the stacking mechanism a second distance based on the second size of the second sheet of print media, wherein the second sheet of print media is positioned over the first sheet of print media. As used herein, a first sheet of print media positioned over a second sheet of print media includes stacking a surface of the first sheet of print media on or directly on a surface of the second sheet of print media. In some examples, the first tamper 114 can be instructed by the controller 102 to move in the direction of arrow 119 the second distance based on a size of the second sheet of print media. For example, the controller 102 can determine a size of the second sheet of print media and move a particular distance to move an edge of the second sheet of print media to the second tamper 116.

In some examples, the first sheet of print media can be received before the second sheet of print media. In these examples, the first sheet of print media can be tamped by the first tamper 114 a first distance and clamped at a position with an edge of the first sheet of print media aligned or in contact with the second tamper 116. As used herein, to clamp a sheet of print media includes a physical clamp that prevents movement of the sheet of print media. In these examples, the second sheet of print media can be received after the first sheet of print media. In these examples, the second sheet of print media can be tamped by the first tamper 114 a second distance and clamped on or above the first sheet of print media at a position with an edge of the second sheet of print media aligned or in contact with the second tamper 116. In these examples, the edge of the first sheet and the second sheet of print media can be aligned or in contact with the second tamper 116.

In some examples, the controller 102 may include instructions 110 stored in the memory resource 104 and executable by the controller 102 to tamp a third sheet of print media received at the stacking mechanism the second distance when the third sheet of print media is the first size, wherein the third sheet of print media is positioned over the second sheet of print media. In some examples, the third sheet of print media can be the same size or have the same width as the first sheet of print media. In these examples, the controller 102 can instruct the first tamper 114 to move in the direction of arrow 119 the same distance as when the first tamper 114 tamped the first sheet of print media.

In some examples, the controller 102 can include instructions to compare the third sheet to the second sheet. For example, the media stacking device 100 can receive the second sheet of print media and compare the size of the second sheet of print media to a third sheet of print media to be received by the media stacking device 100. In some examples, the controller 102 can determine which sheet of print media (first sheet, second sheet, third sheet, etc.) is a largest sheet of print media and determine to tamp the third sheet based on the determined largest sheet. In some examples, the controller 102 can determine a largest sheet of print media received at the media stacking device 100 and tamp the sheets of print media based on the determined largest sheet of print media received at the media stacking device 100 for a particular print job. As used herein, a largest sheet of print media can be a sheet of print media with the longest width and/or longest length.

In some examples, the controller 102 can instruct the first tamper 114 to tamp each sheet of print media for a particular print job based on a largest sized sheet of print media for a particular print job. For example, the media stacking device 100 can receive a first sheet of print media and utilize the first tamper 114 to tamp a first distance based on the size of the first sheet of print media. In this example the controller 102 can compare the first size of the first sheet of print media to a second size of a second sheet of print media and instruct the first tamper 114 to tamp the second sheet of print media based on a comparison of the first size and the second size. That is, if the first size is larger than the second size, the controller 102 can instruct the first tamper 114 to tamp the second sheet of print media the first distance and if the first size is smaller than the second size, the controller 102 can instruct the first tamper 114 to tamp the second sheet of media a second distance based on the second size. In this example, the controller 102 can continue to instruct the first tamper 114 to tamp each remaining sheet of the print job based on a largest print media size that can be determined by comparing each remaining sheet to the previously received sheets of print media.

In some examples, the third sheet of print media can be received from the print zone of a printing device after the second sheet of print media and/or the first sheet of print media. In these examples, the second sheet of print media and/or the first sheet of print media can be clamped in a position aligned with the second tamper 116 and the third sheet of print media can be positioned over or above the second sheet of print media such that an edge of the third sheet of print media is aligned or in contact with the second tamper 116. In this way, the first sheet, second sheet, and/or third sheet of print media can be stacked and aligned along the second tamper 116 even though an opposite edge of the first sheet, second sheet, and/or third sheet of print media are not aligned.

As used herein, sheets of print media or edges of print media that are not aligned are sheets or edges that are located at different distances from a fixed position. For example, a first edge of the first sheet, second sheet, and/or third sheet can be aligned with the second tamper 116 when the first edge of the first sheet, second sheet, and/or third sheet are the same or similar distance from the second tamper 116. In another example, a second edge of the first sheet, second sheet, and/or third sheet may not be aligned with the first tamper 114 when the second edge of the first sheet, second sheet, and/or third sheet include different distances between the second edge and the first tamper 114.

In some examples, the controller 102 may include instructions to eject the first sheet, the second sheet, and the third sheet from the stacking mechanism as a stack of print media. In some examples, the media stacking device 100 can include an ejector to move the stacked print media to an output tray in the direction of arrow 117. As used herein, an ejector can be a device for moving print media from a media pathway 118 into an output tray. As used herein, an output tray can be a device for receiving completed print jobs and/or a portion of completed print jobs to be collected by a user. For example, the first sheet, second sheet, and/or third sheet of print media can be aligned with the second tamper 116 as described herein. In this example, the ejector can move the aligned first sheet, second sheet, and/or third sheet of print media in the direction of arrow 117 into an output tray such that a user can collect the aligned first sheet, second sheet, and/or third sheet of print media.

In some examples, the media stacking device 100 can be utilized to align or stack differently sized print media along an edge of the print media. As used herein, print media aligned along an edge includes a plurality of print media that have a common edge that is a particular distance from a fixed point (e.g., second tamper 116, etc.). In some examples, the media stacking device 100 can be coupled to an output of a printing device and/or positioned within a finishing device of the printing device. In some examples, the media stacking device 100 can be utilized to align an edge of differently sized print media to perform a number of additional finishing processes as described herein. For example, the aligned edge of the differently sized print media can be utilized for a stapling process and/or a hole punching process along the aligned edge.

Figure 2:
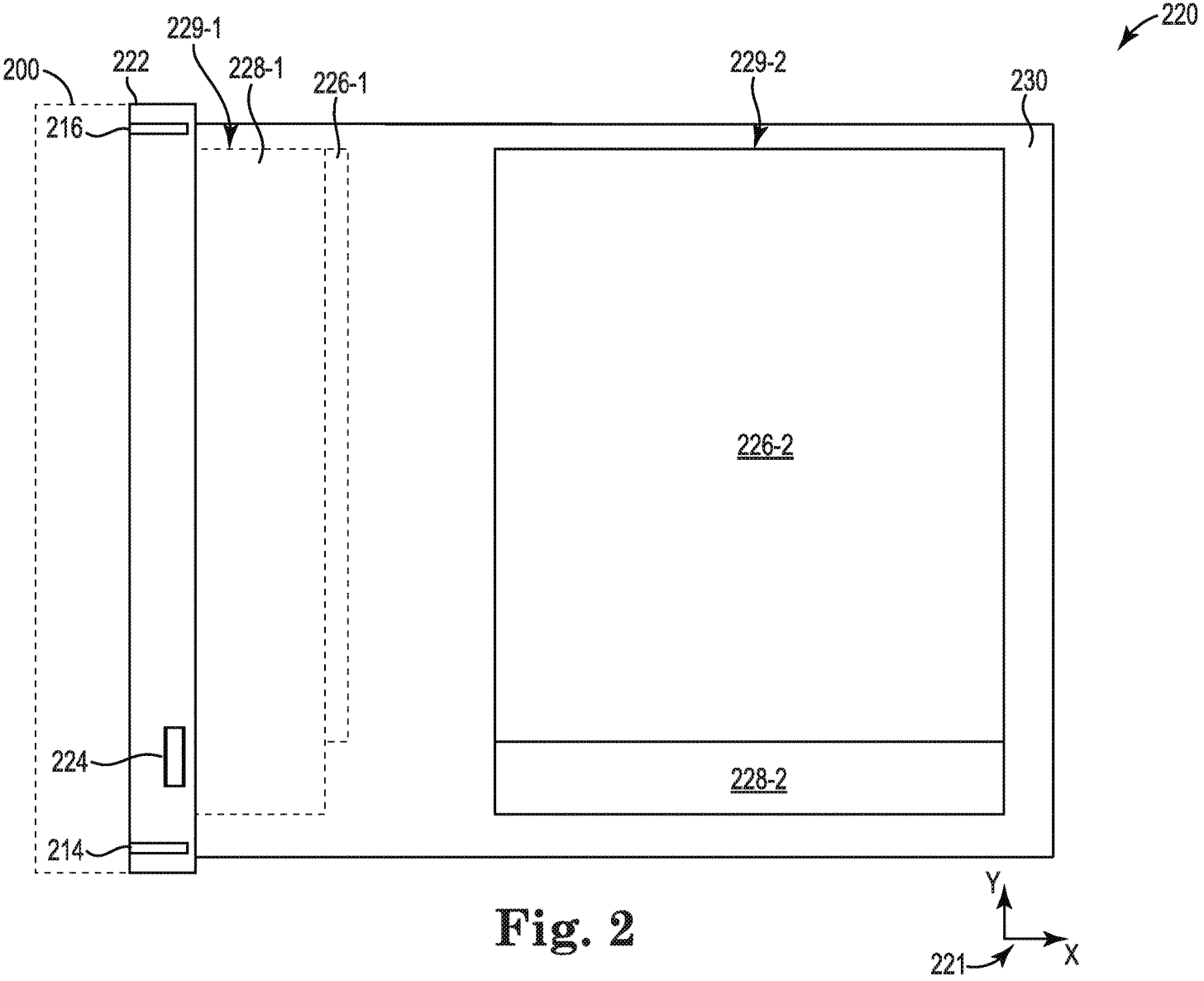
FIG. 2 illustrates an example media stacking system consistent with the present disclosure.

FIG. 2 illustrates an example media stacking system 220 consistent with the present disclosure. In some examples, the system 220 can be utilized to stack or align an edge of differently sized print media. As described herein, differently sized print media can include a plurality of sheets of print media that have different sizes. In some examples, the media stacking system 220 can align the differently sized print media along an edge 229-1, 229-2 even when an opposite edge is not aligned.

In some examples, the system 220 can include a printing device 200 to generate markings on print media of a first size and a second size that is different than the first size. For example, the printing device 200 can deposit a print substance on print media as described herein. In some examples, the printing device 200 can provide print media with deposited print substance to a finisher device 222 or stacking mechanism as described herein. In some examples, the printing device 200 can generate markings on a first set 226-1 of print media at the finisher device 222 that can be ejected into an output tray 230 as the first set 226-1 of print media. In another example, the printing device 200 can generate markings on a second set 228-2 of print media at the finisher device 222 that can be aligned and ejected into the output tray 230 as the second set 228-2 of print media. In some examples, the first set 226-1 and the second set 228-1 of print media can be aligned along the edge 229-1 in finisher device 222. In some examples, the first set 226-2 and the second set 228-2 of print media can be aligned along the edge 229-2 in the output tray 230.

In some examples, the system 220 can include a finisher device 222. As used herein, a finisher device 222 can be a device that performs a finishing process as described herein. For example, the finisher device 222 can align or stack print media received from the printing device 200. In some examples, the finisher device 222 can perform additional finishing processes such as a stapling process and/or hole punching process on the edge 229-1 of the print media.

In some examples, the finisher device 222 can receive a first set of print media that is a first size. As used herein, a set of print media can include sheets of print media of a particular size. For example, the first set 226-1 of print media can include sheets of print media that is a size of A4. The finisher device 222 can receive a second set 228-1 of print media that is a second size such as Letter, or Legal. Furthermore, the finisher device 222 can receive a third set of print media of the A4 size. In some examples, the first set 226-1, second set 228-1, and/or third set of print media can be part a single print job. For example, the finisher device 222 can receive the first set 226-1, second set 228-1, and/or third set as a stack of print media for a single print job that includes differently sized print media.

In some examples, the system 220 can include a first tamper 214 and a second tamper 216 coupled to the finisher device 222. As described herein, the first tamper 214 and the second tamper 216 can be utilized to align and/or stack sized print media. In some examples, the first tamper 214 can tamp the first set 226-1 of print media a first distance based on the first size of set of print media. For example, the first set 226-1 can be tamped to align the edge 229-1 with the second tamper 216. In some examples, the first set 226-1 can be ejected from the finisher device 222 when it is determined that a second set 228-1 is being received by the printing device 200. That is, the first set 226-1 can be ejected into the output tray 230 when a second set 228-1 is to be received at the finisher device 222.

In some examples, the system 220 can include an ejector 224 that can eject the sets of print media into the output tray 230 at a particular offset based on the size of the set of print media. As used herein, an offset can include a distance in the y-direction as illustrated by compass 221 that the ejector 224 outputs the sets 226-1, 228-1 of print media into the output tray 230. For example, the ejector 224 can provide a different offset for different print jobs to allow a user to more easily identify a first print job from a second print job. In some examples, the ejector 224 can be utilized to offset the first set 226-1 of print media a first distance and offset the second set 228-1 a second distance such that the first set 226-2 and the second set 228-2 are aligned along edge 229-2 in the output tray 230.

In some examples, the edge 229-1 and the edge 229-2 are not the same distance from an edge of the output tray 230. That is, the ejector 224 may offset the first set 226-1 a first distance to provide the first set 226-2 of print media within the output tray 230 at a particular distance from the edge of the output tray 230. In addition, the ejector 224 may offset the second set 228-1 a second distance to provide the second set 228-2 of print media within the output tray 230 at the particular distance from the edge of the output tray 230. In this way, the ejector 224 aligns the first set 226-2 and the second set 228-2 along the edge 229-2.

FIG. 2 illustrates a first set 226-1, 226-2 and a second set 228-1, 228-2 of print media, however additional sets of print media can be stacked or aligned along the edge 229-2 by utilizing the ejector 224 to offset the additional sets to align with the edge 229-2. In these examples, each set from a plurality of sets can be tamped individually and aligned by the ejector 224 in the output tray 230. For example, the ejector 224 can eject a first set 226-1 of media with a first offset based on a first size of the first set 226-1 of media. The ejector 224 can eject a second set 228-1 of media with a second offset to align an edge of the first set 226-2 of media with an edge of the second set 228-2 of media within the output tray 230. Furthermore, the ejector 224 can eject a third set of media with the first offset to align the edge of the second set 228-2 of media with an edge of the third set of media. In this example, the first set 226-2 of media and the third set of media can have the same or similar size and the second set 228-2 of media can be different from the first set 226-2 and the third set.

In some examples, the ejector 224 can position the first set 226-1 of media, the second set 228-1 of print media, and third set of print media on the output tray 230 such that the edge 229-2 of the first set 226-2 of media, the edge of the second set 228-2 of media, and the edge of the third set of media are aligned on the output tray 230. In some examples, the ejector 224 can eject the first set 226-1 of media, the second set 228-1 of media, and a third set of media based on a smallest media size for a complete print job. For example, the offset utilized by the ejector 224 can be based on the second set 228-1 of media when the second set 228-1 is a smaller size than the first set 226-1 of media.

In some examples, the offset of ejector 224 can be based on a location of an edge of the set of print media. For example, the first offset for the first set 226-1 can be based on the edge 229-1 of the first set 226-1 of media and the second offset can be based on the edge 229-1 of the second set 228-1 of media. Previous systems utilized the center of the media to determine an offset, which would not result in an aligned edge 229-2 within the output tray 230 when differently sized media is being stacked or aligned within the output tray 230.

In some examples, the system 220 can be utilized to tamp a plurality of differently sized sets of print media and eject each of the plurality of differently sized sets of print media at an offset to align an edge 229-2 of the differently sized sets of print media within the output tray 230. In some examples, the ejector 224 can be utilized with particular offset distances based on an edge of the media to avoid having a stack of differently sized sets of print media within or on the output tray 230 that is not aligned on the edge 229-2.

Figure 3:
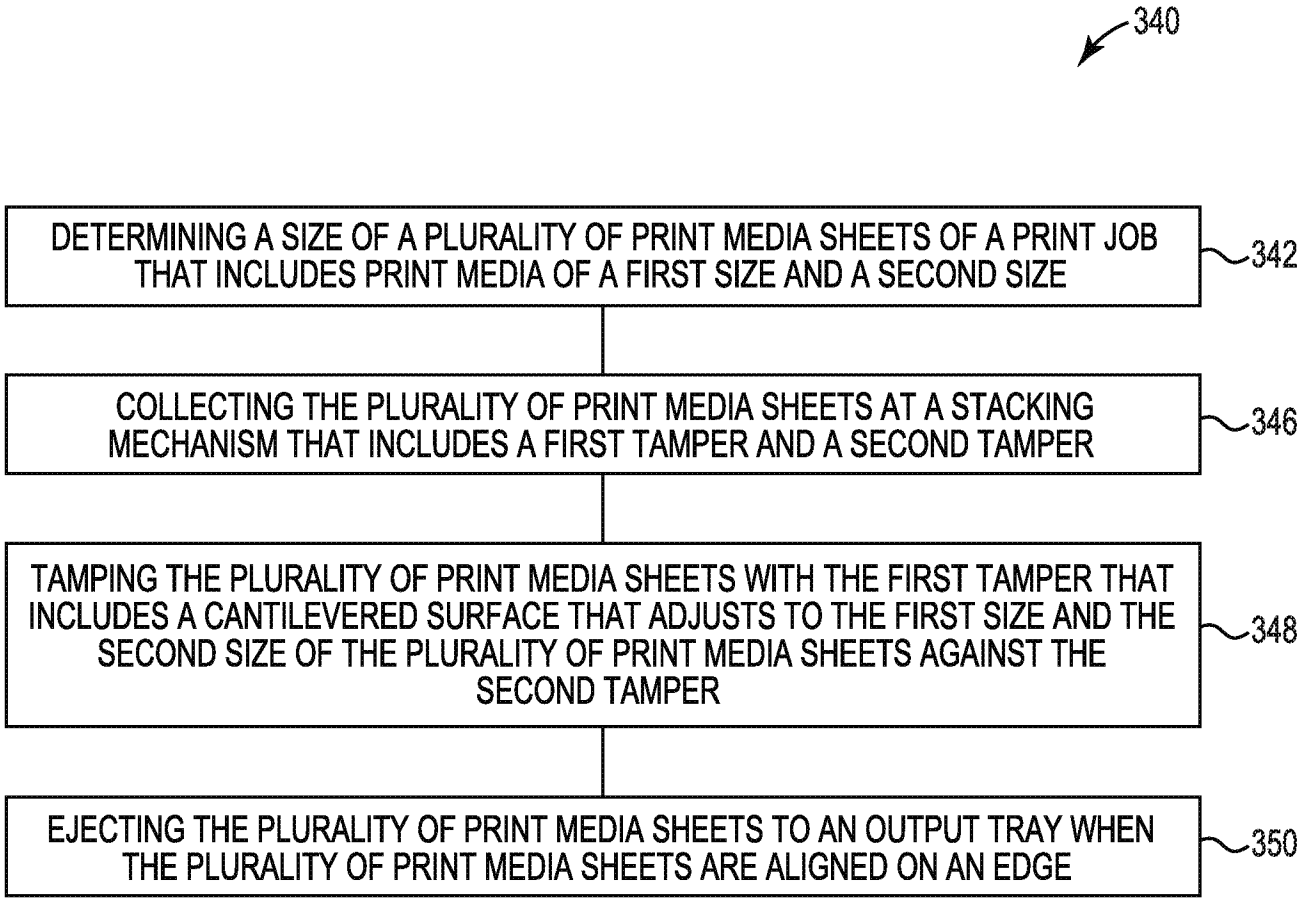
FIG. 3 illustrates an example method for media stacking consistent with the present disclosure.

FIG. 3 illustrates an example method 340 for media stacking consistent with the present disclosure. In some examples, the method 340 can be performed by a printing device and/or media stacking device as described herein. In some examples, the method 340 can be instructions that are executed by a controller or processing resource as described herein.

At 342, the method 340 can include determining a size of a plurality of print media sheets of a print job that includes print media of a first size and a second size. As described herein, determining a size of a plurality of print media sheets can include utilizing a digital transmission that describes the images and finishing processes of a print job. In some examples, the digital transmission can include a plurality of different images or marks and corresponding print media sizes to be utilized for each of the plurality of different images or marks. In some examples, the print media sizes can be different for each or a portion of the plurality of images.

In some examples, determining a size of the plurality of media sheets can include determining an order of sheets and/or sets to be received at a finisher device or stacking device. In this way, the method 340 can predict the size of the next sheet or set of print media and utilize a tamper to tamp a corresponding distance to align the differently sized print media.

At 346, the method 340 can include collecting the plurality of print media sheets at a stacking mechanism that includes a first tamper and a second tamper. As described herein, a stacking mechanism or finisher device can be utilized to align differently sized print media into a single stack. In some examples, the plurality of sheets can be collected at a media pathway (e.g., media pathway 118 as reference in FIG. 1, etc.) between a first tamper and a second tamper. In some examples, the collected media can be held or clamped between the first tamper and the second tamper until the first tamper and/or the second tamper tamp the plurality of sheets into a stack with an edge that is aligned. In some examples, the plurality of sheets collected between the first tamper and the second tamper can be the complete print job. In other examples, the plurality of the sheets collected between the first tamper and the second tamper can be a portion of the complete print job.

At 348, the method 340 can include tamping the plurality of print media sheets with the first tamper that includes a cantilevered surface that adjusts to the first size and the second size of the plurality of print media sheets against the second tamper. As used herein, a cantilevered surface is a surface with a plurality of compliant members or areas with different distances from a fixed point. For example, a cantilevered surface can include a plurality of protrusions that are spaced at a particular distance and where each of the plurality of protrusions can be a different size. In some examples, each of the plurality of compliant members can correspond to a particular size of print media.

Figure 4:
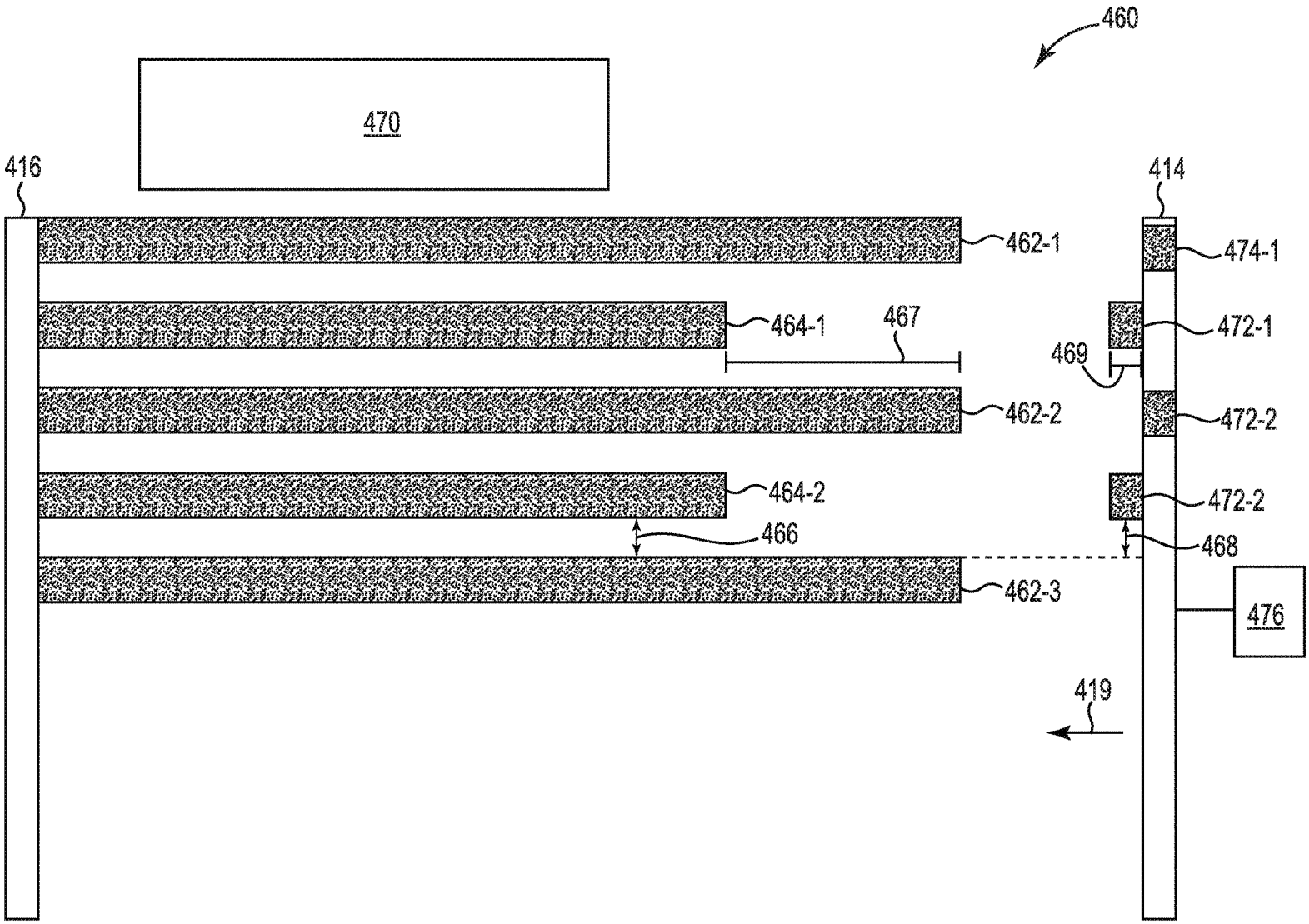
FIG. 4 illustrates an example finishing device consistent with the present disclosure.

In some examples, the method 340 can include collecting the plurality of differently sized print media between the first tamper and the second tamper and simultaneously tamp the plurality of differently sized print media utilizing a first tamper that has a cantilevered surface to align an edge of the plurality of differently sized print media. In some examples, the cantilevered surface of the first tamper can be adjusted based on the different sizes of print media within the collected plurality of differently sized print media. For example, the cantilevered surface can include adjustable compliant members that can increase or decrease in size to alter a position of a corresponding sheet or set of print media a particular distance. For example, a first compliant member can be adjusted to a relatively greater size when the first compliant member is tamping a relatively smaller sheet or set of print media. In a similar example, a second compliant member can be adjusted to a relatively smaller size when the second compliant member is tamping a relatively larger sheet or set of print media. In this way, the relatively larger sheet or set of print media is moved a smaller distance and the relatively smaller sheet or set of print media is moved a greater distance. In this way an edge of the relatively larger sheet or set of print media can be aligned with an edge of the relatively smaller sheet or set of print media. An example of a cantilevered surface with a plurality of compliant members is illustrated in FIG. 4.

At 350, the method 340 can include ejecting the plurality of print media sheets to an output tray when the plurality of print media sheets are aligned on an edge. As described herein, an ejector can be utilized to remove the print media from a stacking mechanism or finisher device and position the print media on an output tray. In some examples, the ejector can eject the plurality of print media sheets a particular offset as described herein. When the plurality of print media sheets include all of the print media sheets for a complete print job the ejector can utilize a single offset for ejecting the plurality of print media sheets. However, when the plurality of print media sheets are a portion of a complete print job, the ejector can eject each portion of the complete print job a particular offset based on the aligned edge of the plurality of print media sheets such that the aligned edge of each of the portions of the print job are aligned in the output tray.

In some examples, the second tamper is a stationary tamper utilized as a registration surface for the edge of the plurality of print media sheets. As described herein, the first tamper can be a moveable tamper that can move the plurality of print media sheets in a particular direction toward the second tamper. In these examples, the second tamper can act as a registration surface to align an edge of the plurality of print media sheets.

In some examples, the method 340 can be utilized to align or stack a plurality of differently sized print media sheets or sets. In some examples, the method 340 can utilize a cantilevered tamper or a tamper with a cantilevered surface to tamp and align a stack of print media that is not aligned. In this way, the plurality of print media sheets can be aligned within the stacking mechanism or finisher device. In some examples, an additional finishing process can be performed when the plurality of differently sized media is aligned or stacked at the stacking mechanism or finisher device compared to aligning or stacking in the output tray.

FIG. 4 illustrates an example finishing device 460 consistent with the present disclosure. In some examples, the finishing device 460 can be a stacking device or stacking mechanism as described herein. In some examples, the finishing device 460 can include a first tamper 414 and a second tamper 416. In some examples, the first tamper 414 can be coupled to an actuator to move the first tamper 414 in the direction of arrow 419 and move a stack of print media to align with a surface of the second tamper 416 that can act as a registration surface.

In some examples, the first tamper 414 can include a cantilevered surface. As described herein, a cantilevered surface can be a surface with a plurality of compliant members 472-1, 472-2, 474-1, 474-2. As described herein, the plurality of compliant members 472-1, 472-2, 474-1, 474-2 can be protrusions or areas of the cantilevered surface with different sizes. For example, compliant members 474-1, 474-2 can be a first distance relative to a fixed point of the first tamper 414 and compliant members 472-1, 472-2 can be a second distance relative to the fixed point of the first tamper 414. In some examples the plurality of compliant members 472-1, 472-2, 474-1, 474-2 can correspond to print media 462-1, 462-2, 464-1, 464-2. In some examples, the print media 462-1, 462-2, 464-1, 464-2 can be individual sheets of print media and/or sets of print media with a common size. For example, print media 462-1, 462-2 can be individual sheets or a set of print media of a first size and print media 464-1, 464-2 can be individual sheets or a set of print media of a second size that is different than the first size.

In some examples, the plurality of compliant members 472-1, 472-2, 474-1, 474-2 can correspond to print media of a corresponding size. For example, compliant members 474-1 can be a first size that corresponds to the print media 462-1 and the compliant member 472-1 can be a second size that corresponds to print media 464-1. In some examples, the plurality of compliant members 472-1, 472-2, 474-1, 474-2 can be utilized to align the print media 462-1, 462-2, 464-1, 464-2 along the second tamer 416. In some examples, the plurality of compliant members 472-1, 472-2, 474-1, 474-2 can be adjustable for differently sized print media and different orders of differently sized print media.

In some examples, the plurality of compliant members 472-1, 472-2, 474-1, 474-2 be extendable or retractable with an actuator 476. For example, the actuator 476 can be utilized alter a position of compliant member 474-1 from a first distance to a second distance. In this example, the compliant member 474-1 can be altered by the actuator 476 from an illustrated distance to a distance 469 as illustrated by compliant member 472-1. In a similar example, the compliant member 472-1 can be altered by the actuator from a distance of 469 to a distance illustrated by compliant member 474-1.

In some examples, the distance of the plurality of compliant members 472-1, 472-2, 474-1, 474-2 can be based on a size of the print media 462-1, 462-2, 464-1, 464-2 such that when the first tamper 414 moves in the direction of arrow 419, the plurality of compliant members 472-1, 472-2, 474-1, 474-2 can each interact with the corresponding print media 462-1, 462-2, 464-1, 464-2. In this way, the differently sized print media 462-1, 462-2, 464-1, 464-2 can each be simultaneously moved to the second tamper 416. For example, the print media 464-1 can be a distance 467 that is shorter than print media 462-1. In this example, the compliant member 474-1 can be a distance 469 shorter than compliant member 472-1 so that the compliant member 472-1 can move the print media 464-1 to the second tamper 416 while the compliant member 474-1 can move the print media 462-1 to the second tamper 416.

In some examples, the cantilevered surface includes a plurality of compliant members 472-1, 472-2, 474-1, 474-2 that are positioned at a distance 468 not less than the difference between the first size and the second size (e.g., distance 466). That is, the distance 468 should not be less than the distance 466. In this way, the cantilevered surface of the first tamper 414 can simultaneously align the print media 462-1, 462-2, 464-1, 464-2 along the second tamper 416.

In some examples, the plurality of compliant members 472-1, 472-2, 474-1, 474-2 can each be individually loaded by a resistive mechanism. For example, the plurality of compliant members 472-1, 472-2, 474-1, 474-2 can be loaded by a spring mechanism such that a distance 469 can be adjusted based on the size of the print media 462-1, 462-2, 464-1, 464-2. For example, a compliant member 474-1 can make contact with an edge of the print media 462-1 and when the print media 462-1 makes contact with the second tamper 416 the compliant member 474-1 can depress the spring to allow compliant member 472-1 to make contact with print media 464-1. When each of the plurality of compliant members 472-1, 472-2, 474-1, 474-2 are individually spring loaded, each of differently sized sheets or sets of print media 462-1, 462-2, 464-1, 464-2 can be individually tamped to the second tamper 416.

In some examples, the finishing device 460 can perform additional finishing processes utilizing a finisher 470. As used herein, a finisher 470 can include a device that can perform a finishing process. For example, the finisher 470 can be a stapler to staple the print media 462-1, 462-2, 464-1, 464-2 on an edge aligned by the second tamper 416. In another example, the finisher 470 can be a hole punch that can punch a hole in the print media 462-1, 462-2, 464-1, 464-2 on an edge aligned by the second tamper 416.

In some examples, the finishing device 460 can be utilized to align or stack a plurality of differently sized print media sheets or sets. In some examples, the finishing device 460 can utilize a cantilevered tamper or a tamper with a cantilevered surface to tamp and align a stack of print media that is not aligned. In this way, the plurality of print media sheets can be aligned within the stacking mechanism or finisher device 460. In some examples, an additional finishing process can be performed by a finisher 470 when the plurality of differently sized media is aligned or stacked at the stacking mechanism or finisher device compared to aligning or stacking in the output tray.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. As used herein, the designator "N", particularly with respect to reference numerals in the drawings, indicates that a number of the particular feature so designated can be included with examples of the present disclosure. The designators can represent the same or different numbers of the particular features. Further, as used herein, "a number of" an element and/or feature can refer to a single or plurality of such elements and/or features.

What is claimed:

1. A printing device, comprising:

a stacking mechanism that includes a tamper to tamp print media positioned within the stacking mechanism; and a controller to execute instructions to:

instruct the tamper to tamp a first single sheet of print media received at the stacking mechanism a first distance based on a first size of the first single sheet of print media;

instruct the tamper to tamp a second single sheet of print media received at the stacking mechanism a second distance based on a second size of the second single sheet of print media, wherein the second single sheet of print media is positioned over the first single sheet of print media; and instruct the tamper to tamp a third single sheet of print media received at the stacking mechanism the second distance when the third single sheet of print media is the first size, wherein the third single sheet of print media is positioned over the second single sheet of print media to generate a stack of print media that includes the first single sheet, the second single sheet, and the third single sheet with a first edge of the stack that is aligned and an opposite edge of the stack that is not aligned; and instruct a finisher device to perform a finishing process on the edge of the stack.

2. The printing device of claim 1, wherein the controller is to execute instructions to eject the first single sheet, the second single sheet, and the third single sheet from the stacking mechanism as the stack of print media.

3. The printing device of claim 1, wherein the first size includes a width that is smaller than the second size.

4. The printing device of claim 1, wherein the tamper includes a tamping surface that includes a plurality of compliant members.

5. The printing device of claim 4, wherein the plurality of compliant members are cantilevered a distance that is a difference between the first size and the second size.

6. The printing device of claim 1, comprising a fixed tamper positioned opposite to the tamper to register the print media when the tamper alters a position of the print media.

7. A system, comprising:

a printing device to generate markings on print media of a first size and a second size that is different than the first size;

a finisher device coupled to the printing device to:

receive a first set of print media of the first size;

receive a second set of print media of the second size; and receive a third set of print media of the first size;

a tamper coupled to the finisher device to:

tamp the first set of print media a first distance based on the first size;

tamp the second set of print media a second distance based on the second size; and tamp the third set of print media the first distance based on the first size; and an ejector coupled to the finisher device to:

eject the first set of media with a first offset based on the first size;

eject the second set of media with a second offset to align an edge of the first set of media with an edge of the second set of media; and eject the third set of media with the first offset to align the edge of the second set of media with an edge of the third set of media, wherein the first set of media, the second set of media, and the third set of media are received as a stack of print media by the finisher device as a single print job such that the finisher device performs a finishing process on the edge of the stack of print media.

8. The system of claim 7, comprising an output tray to receive the first set of print media, the second set of print media, and the third set of print media as the stack of print media from the ejector.

9. The system of claim 8, wherein the ejector positions the first set of media, the second set of print media, and the third set of print media on the output tray such that the edge of the first set of media, the edge of the second set of media, and the edge of the third set of media are aligned on the output tray and an opposite edge of the stack are not aligned.

10. The system of claim 7, wherein the first offset is based on the edge of the first set of media and the second offset is based on the edge of the second set of media.

11. The system of claim 7, wherein the ejector is to eject the first set of media, the second set of media, and the third set of media based on a smallest media size for a complete print job.

12. A method, comprising:

determining a size of a plurality of print media sheets of a print job that includes print media of a first size and a second size;

collecting the plurality of print media sheets at a stacking mechanism that includes a first tamper and a second tamper;

tamping the plurality of print media sheets with the first tamper that includes a cantilevered surface that adjusts to the first size and the second size of the plurality of print media sheets against the second tamper, wherein the plurality of print media sheets are tamped to generate a stack with a first edge of the stack that is aligned and an opposite edge of the stack that is not aligned;

performing a finishing process on the first edge of the stack; and ejecting the plurality of print media sheets to an output tray when the plurality of print media sheets are aligned on the first edge.

13. The method of claim 12, wherein the second tamper is a stationary tamper utilized as a registration surface for the first edge of the plurality of print media sheets.

14. The method of claim 12, wherein the cantilevered surface includes a plurality of compliant members that are positioned at a distance not less than a difference between the first size and the second size.

* * * * *